US007422296B2

(12) United States Patent
Williquette et al.

(10) Patent No.: US 7,422,296 B2
(45) Date of Patent: Sep. 9, 2008

(54) SHEET DISPENSER DISPLAY STRIP

(75) Inventors: Jeffrey G. Williquette, Neenah, WI (US); Jane C. Robbins, Duxbury, MA (US)

(73) Assignee: WS Packaging Group, Inc., Algoma, WI (US)

( * ) Notice: Subject to any disclaimer, the term of this patent is extended or adjusted under 35 U.S.C. 154(b) by 146 days.

(21) Appl. No.: 10/882,370

(22) Filed: Jul. 1, 2004

(65) Prior Publication Data

US 2005/0006990 A1 Jan. 13, 2005

Related U.S. Application Data

(60) Provisional application No. 60/485,276, filed on Jul. 7, 2003.

(51) Int. Cl.
*A47F 1/00* (2006.01)

(52) U.S. Cl. ..... 312/61; 312/50; 211/70.1

(58) Field of Classification Search ..... 312/34.1, 312/34.4, 35, 42, 50, 60, 61, 71, 114, 118, 312/121, 183, 188, 190, 193, 234, 234.1; 221/56, 58, 52, 59; 206/461, 464, 466, 467, 206/806; 211/113, 118, 70.1, 72, 73; 248/174
See application file for complete search history.

(56) References Cited

U.S. PATENT DOCUMENTS 537,613 A * 4/1895 Lucas ..... 221/58
1,694,930 A * 12/1928 Seel ..... 312/42
2,104,523 A * 1/1938 Lichtenstein ..... 221/197
2,314,765 A * 3/1943 Brunner ..... 211/70.1
2,666,531 A * 1/1954 Anderson, Jr. ..... 108/99
2,738,898 A * 3/1956 Lee ..... 221/35
2,973,091 A * 2/1961 Berry ..... 206/317
4,130,197 A * 12/1978 Fox ..... 206/45.26
4,382,526 A * 5/1983 Stone ..... 221/34
4,583,641 A * 4/1986 Gelzer ..... 206/479
5,002,187 A * 3/1991 Rysner et al. ..... 206/461
5,429,430 A * 7/1995 Johnson ..... 312/128
5,979,699 A * 11/1999 Simpson ..... 221/52
5,979,700 A * 11/1999 Suess ..... 221/56
6,158,593 A * 12/2000 Olsen ..... 211/14
6,367,654 B1 * 4/2002 Simpson ..... 221/58
2002/0092859 A1 * 7/2002 Simpson ..... 221/58

* cited by examiner

*Primary Examiner*—Janet M Wilkens
(74) *Attorney, Agent, or Firm*—Reinhart Boerner Van Deuren s.c.

(57) ABSTRACT

A point of purchase display includes a hangable display strip having a coupon dispenser box and a plurality of mounts formed from a single sheet blank. The products can be supported from underneath by support ledges and retained by holsters hinged to the strip at one side and slots in the strip. The ledges are simple flaps hinged to the strip at one edge joined by a tab and slot connection at the other side. The dispenser box is formed from a flap of the blank folded into five sides, one of which is hinged to the strip and two others of which have tabs that fit into slots in the strip. A strip-like flap of the blank fits through a cut out and forms an arched spring inside the dispenser box biasing a stack of coupons toward an opening for dispensing one at a time.

16 Claims, 2 Drawing Sheets

10
12
14
16
18
19
21
22
24
26
28
30
32
34
36
38
40
42
44
46
48
50
52
54
55
56
58
60
62
64
66
68
69
70
72A
72B
72C
72D
74A
74B
74C
76
78
80
82
84
86
88
90
92
100
104

SHEET DISPENSER DISPLAY STRIP

CROSS-REFERENCE TO RELATED APPLICATION

This claims the benefit of U.S. Provisional Patent Application No. 60/485,276 filed Jul. 7, 2003.

STATEMENT OF GOVERNMENT SPONSORED DEVELOPMENT

Not Applicable.

BACKGROUND OF THE INVENTION

This invention relates to product displays and in particular to hangable product display strips.

Product manufacturers and suppliers want their products displayed in prominent locations in an eye-catching manner likely to attract consumers. Retail outlets typically wish to maximize the quantity of products displayed for sale, and thus, premium shelf and floor space is limited. One way to increase the available space for display of certain products in high traffic areas, such as aisle end caps and check out lanes, is to attach the products to display strips. Such strips typically mount to the front of a shelf and sometimes project out into the aisle to make them more visible.

One example of a product display strip can be found in U.S. Pat. No. 6,286,690. This display strip includes a vertical support that mounts to the front of shelving and holds a wire bracket suspending a metal strip. The strip has a number of vertically spaced tabs or tongues cut out at all but one side on which the products are hung. Each tongue is bent at an angle away from the strip so that products can hang on the strip by simply slipping the tongue in a slot formed in the product package.

Such conventional product display strips are disadvantageous because they require the products being displayed to be adapted for hanging, such as by attaching a hanger to the product or by having packaging with a hanger feature. And, because the products are suspended, they are susceptible to falling from the display and being damaged, for example in the event the hanger breaks or the hanger is not properly seated on the hook. This problem is exacerbated when the display is loaded with many products suspended closely together and overlapping each other (as is common), which makes it likely that the consumer will inadvertently knock off one or more products adjacent the product being taken from the display.

It is also common for producers, especially of food products, to issue coupons that can be redeemed at the retail outlets for a reduction in the cost of the product. The coupons can be provided to the consumers at the point of purchase as a way of enticing consumers to purchase their products rather than their competitor's. Manual and automated coupon dispensers have been developed and utilized for dispensing one coupon at a time to the consumer. For example, manual dispenser boxes of the type for dispensing one coupon from a stack of coupons are disclosed in U.S. Pat. Nos. 5,979,699 and 6,367,654 assigned to the assignee of the present invention, which are hereby incorporated by reference as though fully set forth herein. These dispensers include a container holding a stack of the individual coupons, which may be folded (and possibly interleaved). Some device or technique for issuing a single coupon at a time may also be incorporated into the dispenser. For example, the containers may house a spring element to push the coupons toward an access opening so that only the upper or outermost sheet sticks out of the access opening so only it can be easily grasped.

Such conventional dispensers are usually mounted to the front of shelving holding the item(s) for sale associated with the coupon. These dispensers can be disadvantageous in that they require separate mounting hardware. Moreover, it is possible for the dispenser to become dislocated from the associated product(s), for example if the products are stocked in free standing displays or near check out aisles wherein suitable mounts are unavailable.

Accordingly, an improved product display which addresses the shortcomings of the prior art is needed.

BRIEF SUMMARY OF THE INVENTION

In one aspect the invention provides a product display strip made of a sheet material with at least one product mount and a dispenser box. The dispenser box contains a stack of individual sheets so that a top sheet of the stack of sheets is disposed at an opening in the dispenser box.

Preferably, the display is formed from a single sheet blank. The blank is cut and perforated as needed to define the main strip as well as flaps located along fold lines. One flap defines the walls of the dispenser box, while another is a rectangular strip that forms a biasing member. One or more sets of two additional flaps form the features of the product mounts.

In one preferred form the display strip is elongated in a direction between top and bottom ends to have a greater length than side to side dimension. Multiple product mounts are spaced apart in the length dimension beneath the dispenser box. A shouter area for displaying promotional indicia is located at the top end of the display strip.

In another form each product mount is designed to support a product from underneath, rather than by suspending or hanging it from its top end. To this end, each mount has a support ledge and a holster defining a pocket for receiving a product resting on the ledge. One side of each holster is hinged to the strip along a fold line with its other side engaged in a tab and slot connection. The support ledges are hinged at a single edge along another fold line.

In still other forms, one side of the dispenser box is hinged to the strip along a fold line and two other sides have tabs that fit into slots in the display strip. And, one end of the biasing member is hinged to the display strip along another fold line on an opposite side of a cut out in the display strip from the hinged edge of the dispenser box. The free end of the biasing member fits through the cut out so that much of the biasing member is disposed inside the dispenser box forming an arch shape, which not only acts as a spring but which also imparts a bend in the stack of sheets so that a free end of the top sheet is spaced from an adjacent surface of the stack of sheets.

The present invention thus provides an improved product display having an integral sheet dispenser for, for example, dispensing coupons for the products displayed in the strip. The invention provides a single hangable device for both displaying products and dispensing coupons. The device ensures that the dispenser is located with the associated products. Moreover, the products are held in the strip in a non-hanging manner supporting the products from the bottom and in a holster, thereby making it less likely to drop the products. And, because the display can be manufactured from a single sheet, it can be produced economically and shipped flat with only simple folding required for assembly.

The advantages of the invention will appear from the following description. In this description, reference is made to the accompanying drawings which form a part hereof and in which there are shown by way of illustration a preferred embodiment of the invention. This embodiment does not represent the full scope of the invention. Thus, the claims should be looked to in order to ascertain the scope of the invention.

DETAILED DESCRIPTION OF THE PREFERRED EMBODIMENT

Figures 1, 2:
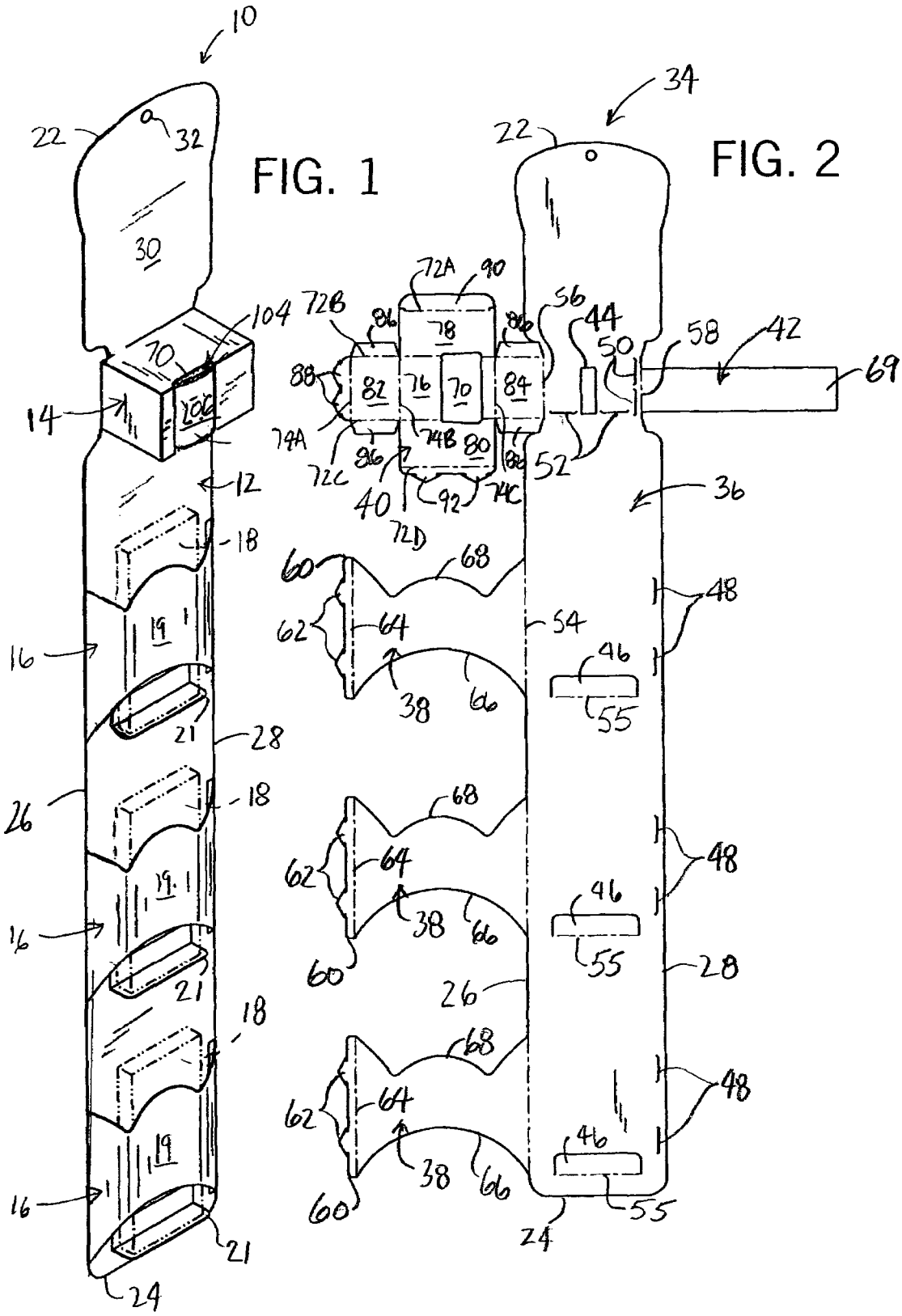
FIG. 1 is a front perspective view of the sheet dispenser display strip according to the present invention.
FIG. 2 is a plan view of a single sheet blank used to form the display of FIG. 1.

A point of purchase display 10 according to the present invention is shown in FIG. 1 to have an elongated display strip 12 made of a sheet material including a sheet dispenser box 14 and three product mounts 16 each holding a product 18 (shown in phantom) in a holster 19 on a support ledge 21. Preferably, the display strip 12 has a top end 22, a bottom end 24, and opposite sides 26 and 28. The display strip 12 is shown as be longer from top to bottom than from side to side with the product mounts 16 spaced apart between the top 22 and bottom 24 ends; however, it can have any aspect ratio or mounting configuration. Preferably, the display strip 12 has a shouter-like display area 30 at the top end 22 where printing or decals can be placed containing text and graphics promoting the associated products 18. Also, the display strip 12 includes some type of mounting feature, which in one form can be a simple hole 32 for suspending the display 10 from a clip, nail or other post like element. Such a mounting feature should be located at the top end 22 of the to allow it to hang plumb. Other mounting features, such as adhesives, magnets, or clips, can be attached at any suitable location, such as at the back side of the sheet slightly above center.

The display 10 can be formed from a single sheet flat blank 34, preferably made of somewhat flexible paperboard or plastic sheeting, which is cut to have the outline shown in FIG. 2. Specifically, the blank 34 defines a strip section 36, three holster flaps 38, a box flap 40 and a spring flap 42. The strip section 36 corresponds to the display strip 12 having the top 22 and bottom 24 ends and opposite sides 26 and 28 as well as hole 32. The strip section 36 is also punch cut to have a cut out 44 between the box flap 40 and the spring flap 42 and three ledge flaps 46 associated with each of the three holster flaps 38. The strip section 36 is further cut to include three pairs of vertically oriented and spaced slots 48, one pair for each holster flap 38 as well as one pair of vertically oriented and spaced slots 50 and one pair of horizontally oriented and spaced slots 52 associated with the box flap 40. The blank 34 is creased, perforated or knick cut (through only a portion of its thickness) along a vertical fold line 54 at the junction of the holster flaps 38 and the strip section 36, along horizontal fold lines 55 at the ledge flaps 46, and along additional vertical fold lines 56 and 58 between the strip section 36 and the box flap 40 and the spring flap 42, respectively.

Regarding the appending flaps, each holster flap 38 has a free end 60 which is formed to define two vertically spaced and horizontally extending pointed tabs 62. The free ends 60 are also formed with vertical fold lines 64. The holster flaps 38 can have arched bottom 66 and top 68 edges (as shown) or any other suitable configuration. The spring flap 42 is a simple rectangular strip-like configuration extending to a free end 69 at a right angle to the extension of the strip section 36 (as do the holster 38 and box 40 flaps). The box flap 40 has a rectangular access opening 70 cut out and four horizontal 72A-72D and three vertical 74A-74C fold lines defining the boundaries of front 76, top 78, bottom 80, left side 82 and right side 84 panels. The left 82 and right 84 side panels have top and bottom tuck flaps 86 and the left side panel 82 also defines two vertically spaced (horizontally extending) tabs 88. The top panel 78 has a tuck flap 90 and the bottom panel 80 has two horizontally spaced (vertically downward extending) tabs 92.

The flat blank 34 can be quickly and easily transformed into the display 10 (as shown in FIG. 1) by folding the flaps along the fold lines mentioned above and connecting the tabs. In particular, the product mounts 16 are formed by folding the holster flaps 38 about 180 degrees clockwise along fold line 54 and folding their free ends 60 about 90 degrees clockwise along fold line 64 so that the tabs 62 can fit into the slots 48, thus forming the holsters 19. The ledge flaps 46 are folded downwardly about 90 degrees along fold lines 55 to form the support ledges 21.

Figure 3:
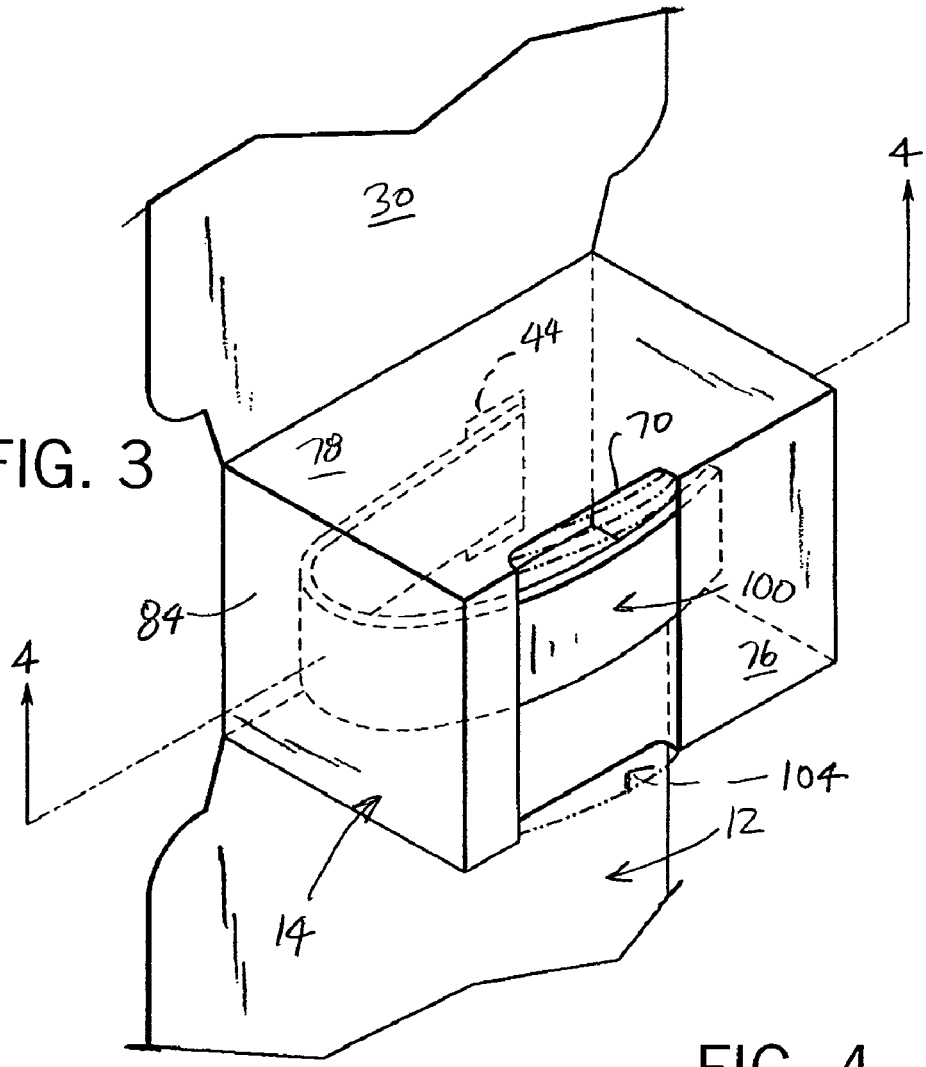
FIG. 3 is an enlarge perspective view of the sheet dispenser portion of the display.
Figure 4:
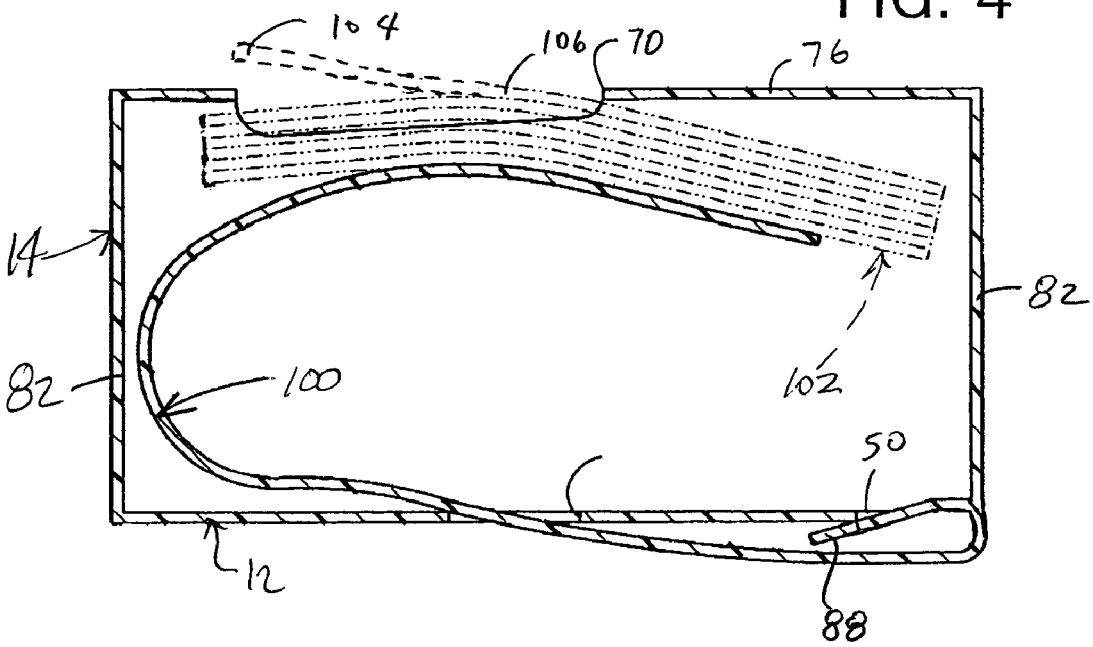
FIG. 4 is a cross-sectional view taken along line 4-4 of FIG. 3 showing a spring member biasing a stack of sheets toward an access opening to facilitate dispensing one sheet at a time.

The dispenser box 14 is formed by folding the flap 40 90 degrees toward the strip section 36 along fold line 56. Then, panel 82 is folded 90 degrees along fold line 74B toward panel 76 and panel 76 is folded 90 degrees along fold line 74C toward panel 84 to be parallel with the strip section 36. Panels 78 and 80 are then folded 90 degrees toward each other along respective fold lines 72B and 72C which trap folded in tuck flaps 86 to the inside of the box. Tuck flap 90 is folded 90 degrees along fold line 72A to the inside of the dispenser box 14. Tabs 88 are folded in 90 degrees along fold line 74A and inserted into the vertical slots 50 and tabs 92 are folded in 90 degrees along fold line 72D and inserted to the horizontal slots 52 to maintain the shape of the dispenser box 14 and secure it to the strip 12. Finally, the spring flap 42 is folded along fold line 58 about 180 degrees and its free end 69 is inserted through the cut out 44 to form an arched spring or biasing member 100, as shown in FIGS. 3 and 4.

The dispenser box 14 holds a stack 102 of individual sheets, preferably coupons associated with the products 18 being displayed, each of which is preferably folded in two to have a tab end 104 intermediate opposite ends of the sheet. The biasing member 100 acts as a spring to provide a force biasing the stack 104 of sheets toward the front panel 76 such that the tab end 104 of an uppermost sheet 106 protrudes through access opening 70. Preferably, this end is spaced from an adjacent surface of the stack 102 of sheets so that it can be grasped easily to facilitate dispensing sheets one by one.

The present invention thus provides an improved product display having an integral sheet dispenser for, for example, dispensing coupons for the products displayed in the strip. The invention provides a single hangable device for both displaying products and dispensing coupons. The device ensures that the dispenser is located with the associated products. Moreover, the products are held in the strip in a non-hanging manner supporting the products from the bottom and in a holster, thereby making it less likely to drop the products. And, because the display can be manufactured from a single sheet, it can be produced economically and shipped flat with only simple folding required for assembly in the field.

While there has been shown and described what is at present considered to be the preferred embodiment of the invention, it will be obvious to those skilled in the art that various changes and modifications can be made to the described embodiment without departing from the scope of the present invention. Accordingly, to ascertain the full scope of the invention, reference must be had to the following claims.

What is claimed is:

1. A product display comprising:

an elongated display strip made of a single sheet of flexible paper or plastic having a front surface, a back surface and opposing side edges, said display strip including at least one product mount extending a distance outwardly from the front surface of the display strip and extending from one of the side edges of the display strip to the other of the side edges of the display strip, the at least one product mount having an open top, an open bottom and opposing closed side ends for mounting and displaying a product on said display strip and a dispenser box extending outwardly from the front surface of the display strip and also extending from one of the side edges of the display strip to the other of the side edges of the display strip, the dispenser box positioned above the at least one product mount, wherein the display strip is elongated in a direction between top and bottom ends of the display strip to have a much greater length than a width, wherein the at least one product mount and the dispenser box are unitary parts of the display strip and wherein the dispenser box is configured for containing a stack of individual sheets so that a top sheet of the stack of sheets is disposed at an opening in the dispenser box, wherein the dispenser box has a first side having an edge extending along a first fold line and a second side engaging the display strip in a tab and slot connection, wherein the dispenser box has a third side perpendicular to the second side engaging the display strip in a tab and slot connection.

2. The product display of claim 1, wherein a biasing member is provided in the box that biases the sheets toward the opening.

3. The product display of claim 2, wherein the biasing member is a unitary part of the dispenser box.

4. The product display of claim 2, wherein the biasing member imparts an arch in the stack of sheets such that a free end of the top sheet is spaced from an adjacent surface of the stack of sheets.

5. The product display of claim 1, wherein the at least one product mount comprises a product support ledge extending outwardly from the front surface of the display strip for supporting products from underneath and a pocket extending from one of the side edges of the display strip to the other of the side edges of the display strip for receiving a product for display on the display strip.

6. The product display of claim 1, wherein the at least one product mount has a support ledge and a holster extending from one of the side edges of the display strip to the other of the side edges of the display strip defining a pocket for receiving a product resting on the support ledge.

7. The product display of claim 6, wherein the at least one product mount is a unitary part of the display strip formed of a single sheet blank and wherein the holster has a first side extending along a fold line and a second side engaging the display strip in a tab and slot connection.

8. The product display of claim 7, wherein the support ledge is joined to the display strip at a single edge extending along a fold line.

9. The product display of claim 1, wherein the display strip defines a shouter area for promotional indicia.

10. The product display of claim 1, wherein a biasing member inside the box is a unitary part of the display strip formed from the single sheet blank and having a first end extending along a second fold line spaced from the first fold line on an opposite side of a cut out in the display strip and having a second end inserted through the cut out and disposed in an interior of the dispenser box such that the biasing member forms an arch shape between the first and second ends.

11. A display strip comprising:

an elongated display strip having a front surface, a back surface and opposing side edges, the elongated display strip made of a single sheet of paper or plastic configured to form a plurality of product mounts that extend outwardly a distance from the front surface of the display strip for retaining a product on the front surface of the display strip, each of the plurality of product mounts having an open top, an open bottom and opposing, closed side ends, with one of the closed side ends of the product mount located substantially at one of the side edges of the display strip and the other of the closed side ends of the product mount located substantially at the other side edge of the display strip, the display strip also including a dispenser box extending from one of the side edges of the display strip to the other of the side edges of the display strip, each of the plurality of product mounts and the dispenser box configured as unitary portions of the display strip, wherein a length of the strip is much longer than a width of the strip and the display strip comprises a plurality of said product mounts, each product mount configured for retaining a three-dimensional product or package on the strip, and wherein the dispenser box is configured for containing a stack of individual sheets of paper so that a top sheet is disposed at an opening in the dispenser box and wherein the strip is assembled only by one or more of perforating, cutting, and folding the single sheet, wherein a pocket for receiving the product is formed by folding a flap having two vertically spaced and horizontally extending pointed tabs.

12. The product display strip of claim 11, further comprising a biasing member formed as a unitary part of the display strip, wherein the biasing member is configured for imparting an arch in the stack of sheets such that a free end of the top sheet is spaced from an adjacent surface of the stack of sheets.

13. The product display strip of claim 11, wherein each product mount comprises a support ledge and an open-bottom pocket for receiving and holding a product.

14. A product display strip comprising:

an elongated display strip having a front surface, a back surface and opposing side edges, the elongated display strip made of a single sheet of paper or plastic, the display strip comprising a plurality of product mounts, each of the plurality of product mounts extending outwardly from the front surface of the display strip and having an open top, an open bottom and opposing, closed side ends; the display strip also comprising a dispenser box extending outwardly from the front surface of the display strip and extending from one of the side edges of the display strip to the other of the side edges of the display strip, the product mount and the dispenser box each formed as unitary parts of the display strip, each mount configured for retaining a product or package on the front surface of the display strip, wherein a thickness of the paper or plastic is much less than both a length and a width of the strip, and wherein the length of the display strip is much greater than the width of the display strip, and wherein each of the plurality of product mounts is configured for displaying a three dimensional product on the front surface of the display strip, and wherein the dispenser box has a first side having an edge extending along a first fold line and a second side engaging the display strip in a tab and slot connection.

15. The product display strip of claim 14 wherein the strip is configured for assembly cutting by one or more of perforating, cutting, and folding the single sheet of paper or plastic.

16. The product display strip of claim 14 further comprising a biasing member formed as a unitary part of the display strip, wherein the biasing member is configured for imparting an arch in a stack of sheets such that a free end of the top sheet is spaced from an adjacent surface of the stack of sheets.

* * * * *